US008967790B2

(12) United States Patent
Yamada et al.

(10) Patent No.: US 8,967,790 B2
(45) Date of Patent: Mar. 3, 2015

(54) SHEET CUTTING DEVICE AND IMAGE FORMING APPARATUS INCLUDING THE SHEET CUTTING DEVICE

(75) Inventors: Masahiko Yamada, Tokyo (JP); Kazuhiro Wakamatsu, Kanagawa (JP); Yuichiro Maeyama, Kanagawa (JP); Masato Ogawa, Kanagawa (JP); Toshihiro Yoshinuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 179 days.

(21) Appl. No.: 13/306,029

(22) Filed: Nov. 29, 2011

(65) Prior Publication Data

US 2012/0140011 A1 Jun. 7, 2012

(30) Foreign Application Priority Data

Dec. 1, 2010 (JP) ..... 2010-268563

(51) Int. Cl.

| | |
|---|---|
| ***B41J 2/01*** | (2006.01) |
| ***B41J 29/38*** | (2006.01) |
| ***B41J 2/175*** | (2006.01) |
| ***B65H 3/30*** | (2006.01) |
| ***B65H 3/12*** | (2006.01) |
| ***B41J 11/70*** | (2006.01) |
| ***B26D 1/04*** | (2006.01) |
| ***B26D 5/06*** | (2006.01) |
| ***B26D 5/08*** | (2006.01) |
| ***B26D 5/20*** | (2006.01) |

(52) U.S. Cl.

CPC ..... *B41J 11/706* (2013.01); *B26D 1/045* (2013.01); *B26D 5/06* (2013.01); *B26D 5/086* (2013.01); *B26D 5/20* (2013.01)

USPC ..... 347/104; 347/16; 347/85; 271/22; 271/94

(58) Field of Classification Search

CPC ..... B41J 11/00

USPC ..... 347/104

See application file for complete search history.

(56) References Cited

U.S. PATENT DOCUMENTS

| | | | | |
|---|---|---|---|---|
| 2003/0146964 | A1* | 8/2003 | Fujiwara | 347/104 |
| 2011/0063644 | A1 | 3/2011 | Niihara et al. | |
| 2011/0064497 | A1 | 3/2011 | Niihara et al. | |

FOREIGN PATENT DOCUMENTS

| | | |
|---|---|---|
| JP | 9-29685 | 2/1997 |
| JP | 2000-272117 | 10/2000 |
| JP | 2009-214200 | 9/2009 |

OTHER PUBLICATIONS

U.S. Appl. No. 13/293,517 of Masato Ogawa et al., filed Nov. 10, 2011.

U.S. Appl. No. 13/307,157 of Yuichiro Maeyama et al., filed Nov. 30, 2011.

Japanese official action dated Oct. 21, 2014 in corresponding Japanese patent application No. 2010-268563.

* cited by examiner

*Primary Examiner* — Alessandro Amari
*Assistant Examiner* — Alexander C Witkowski
(74) *Attorney, Agent, or Firm* — Cooper & Dunham LLP

(57) ABSTRACT

A sheet cutting device includes a cutter including opposed blades to cut a sheet fed along a sheet feed path to the device, a cutter holder holding the cutter and reciprocally movable in a width direction of the sheet perpendicular to a sheet feed direction in which the sheet is fed, and a guide member including a first path to guide the holder in the width direction of the sheet to cut the sheet with the cutter and a second path to guide the holder in the width direction after the sheet is cut. The second path is disposed away from the first path in a thickness direction of the sheet perpendicular to both the sheet feed direction and the width direction of the sheet. When the holder moves along the second path, the holder is retracted away from the sheet feed path in the thickness direction of the sheet.

13 Claims, 7 Drawing Sheets

SHEET CUTTING DEVICE AND IMAGE FORMING APPARATUS INCLUDING THE SHEET CUTTING DEVICE

CROSS-REFERENCE TO RELATED APPLICATIONS

This patent application is based on and claims priority pursuant to 35 U.S.C. §119 to Japanese Patent Application No. 2010-268563, filed on Dec. 1, 2010, in the Japanese Patent Office, the entire disclosure of which is hereby incorporated by reference herein.

TECHNICAL FIELD

This disclosure relates to a sheet cutting device and an image forming apparatus including the sheet cutting device, and more specifically to a sheet cutting device to cut a rolled sheet to a desired length and an image forming apparatus, such as a printer, a copier, and a facsimile machine, including the sheet cutting device.

DESCRIPTION OF THE BACKGROUND ART

Image forming apparatuses are used as printers, facsimile machines, copiers, plotters, or multi-functional devices having two or more of the foregoing capabilities. As a conventional type of image forming apparatus, an image forming apparatus is known that feeds a long-size rolled sheet (hereinafter, rolled sheet) in a certain feed direction (hereinafter, sheet feed direction) to form an image on the rolled sheet.

The image forming apparatus typically has a sheet cutting device to cut the rolled sheet to a desired length by moving a cutter in a direction perpendicular to the sheet feed direction (hereinafter, width direction). The cutter used in the sheet cutting device may be, for example, a pair of circular blades to cut sheets of different thicknesses or materials. In particular, recently, such cutters are widely used in inkjet-type image forming apparatuses capable of forming images on sheets of different thicknesses or materials.

Such a conventional sheet cutting device having the pair of circular blades as the cutter needs to return a cutter holder holding the cutter to an initial position (home position) in preparation for the next sheet cutting. At this time, if a forward path along which the cutter moves to cut the sheet is identical to a backward path along which the cutter moves to return to the home position, the cutter contacts the already-cut sheet on the backward path, thus hampering movement of the cutter holder (so-called "cut jam") or causing other failure.

To prevent such a cut jam or other failure, for example, JP-2009-214200-A proposes a sheet cutting device in which the backward path of the cutter formed with the pair of circular blades differs from the forward path of the cutter. Relative to the forward path, the backward path is arranged at a downstream side in the sheet feed direction in which the sheet is fed along a sheet feed path and at a position away from a leading edge of a subsequent divided sheet upstream from the cutter in the sheet feed direction. Specifically, after the cutter finishes the cutting operation, the cutter holder is tilted toward the downstream side in the sheet feed direction around a guide member for guiding the movement of the cutter holder. Thus, the position of the cutter moving along the backward path in the sheet feed direction is shifted to the downstream side in the sheet feed direction relative to the position of the cutter moving along the forward path.

Such a configuration can prevent the cutter from contacting the already-cut sheet on the backward path, thus preventing a cut jam.

However, the sheet cutting device tilts the cutter holder toward the downstream side in the sheet feed direction to differentiate the forward path from the backward path of the cutter. As a result, the sheet cutting device requires space for the cutter holder to pivot at the downstream side in the sheet feed direction, thus increasing the size of an apparatus main unit including the sheet cutting device.

As described above, in the sheet cutting device, the forward path of the cutter differs from the backward path, thus preventing the cutter from contacting the already-cut sheet. However, the cutter holder still remains on the sheet feed path after cutting operation. As a result, a subsequent sheet cannot be fed from the rolled sheet until the cutter and the cutter holder return to the home position, thus hampering gains in productivity.

BRIEF SUMMARY

In an aspect of this disclosure, there is provided an improved sheet cutting device including a cutter, a cutter holder, and a guide member. The cutter includes opposed blades opposing each other with a sheet interposed therebetween to cut the sheet to a desired length. The sheet is fed along a sheet feed path to the sheet cutting device. The cutter holder holds the cutter and is reciprocally movable in a width direction of the sheet perpendicular to a sheet feed direction in which the sheet is fed along the sheet feed path to the sheet cutting device. The guide member includes a first path to guide the cutter holder in the width direction of the sheet to cut the sheet with the cutter and a second path to guide the cutter holder in the width direction of the sheet after the sheet is cut with the cutter. The second path is disposed away from the first path in a thickness direction of the sheet perpendicular to both the sheet feed direction and the width direction of the sheet. When the cutter holder moves along the second path, the cutter holder is retracted away from the sheet feed path in the thickness direction of the sheet.

In another aspect of this disclosure, there is provided an improved image forming apparatus including an image forming device to form an image on a sheet, a sheet feed device to feed the sheet along a sheet feed path, and a sheet cutting device to cut the sheet fed along the sheet feed path. The sheet cutting device includes a cutter, a cutter holder, and a guide member. The cutter includes opposed blades opposing each other with the sheet interposed therebetween to cut the sheet to a desired length. The cutter holder holds the cutter and is reciprocally movable in a width direction of the sheet perpendicular to a sheet feed direction in which the sheet is fed along the sheet feed path to the sheet cutting device. The guide member includes a first path to guide the cutter holder in the width direction of the sheet to cut the sheet with the cutter and a second path to guide the cutter holder in the width direction of the sheet after the sheet is cut with the cutter. The second path is disposed away from the first path in a thickness direction of the sheet perpendicular to both the sheet feed direction and the width direction of the sheet. When the cutter holder moves along the second path, the cutter holder is retracted away from the sheet feed path in the thickness direction of the sheet.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
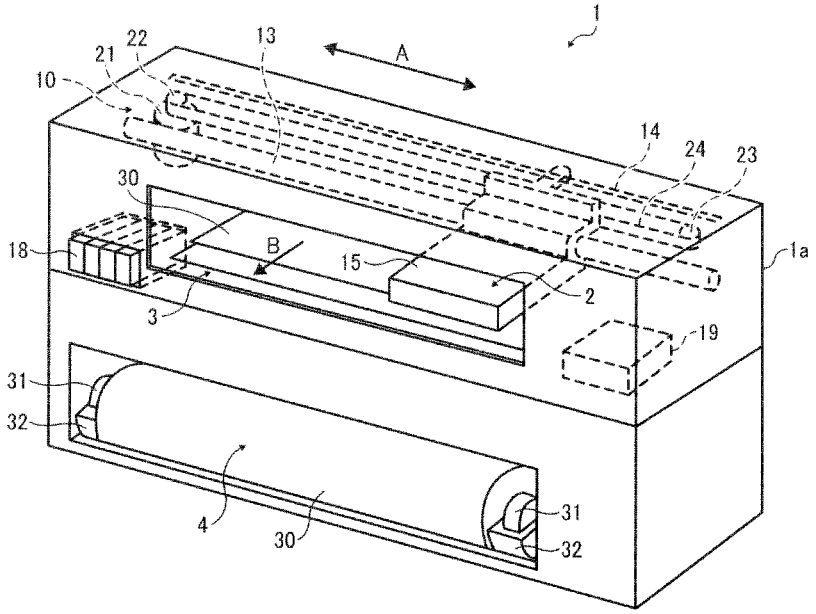
FIG. 1 is a schematic perspective view of an inkjet recording apparatus including a sheet cutting device according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

FIGS. 1 to 12 show a sheet cutting device and an image forming apparatus according to exemplary embodiments of the present disclosure. In FIGS. 1 to 12, an inkjet recording apparatus is illustrated as an example of the image forming apparatus.

In FIG. 1, an inkjet recording apparatus 1 serving as the image forming apparatus is a serial-type inkjet recording apparatus that moves an inkjet head in a width direction (hereinafter, sheet width direction) of a sheet for scanning to form an image on the sheet. After one or more scans are performed to form a line of the image, the inkjet recording apparatus 1 feeds the sheet forward a certain distance to form another line of the image. The image forming apparatus is not limited to the serial-type inkjet recording apparatus but may be, for example, a line-type inkjet recording apparatus having a recording head in which multiple nozzles are arranged across a substantially whole area in the width direction of a sheet to record an image on the sheet without scanning in the width direction.

The inkjet recording apparatus 1 includes an image forming section 2 serving as an image forming device, a sheet feed section 3 serving as a sheet feed device, a rolled sheet storage section 4, and a sheet cutting device 5. The image forming section 2, the sheet feed section 3, the rolled sheet storage section 4, and the sheet cutting device 5 are disposed within an apparatus main unit 1*a*.

In the image forming section 2, a guide rod 13 and a guide rail 14 are extended between side plates, and a carriage 15 is supported by the guide rod 13 and the guide rail 14 so as to be slidable in a direction indicated by an arrow A.

The carriage 15 holds liquid ejection heads (recording heads) 16 to eject ink droplets of, e.g., black (K), yellow (Y), magenta (M), and cyan (C). Sub tanks 17 are integrally provided with the corresponding recording heads 16 to supply color inks to the recording heads 16.

A main scanning mechanism 10 moves the carriage 15 for scanning in a main scanning direction, that is, the sheet width direction indicated by the arrow A. The main scanning mechanism 10 includes a driving motor 21 disposed at a first end in the sheet width direction, a driving pulley 22 rotated by the driving motor 21, a driven pulley 23 disposed at a second end opposite the first end in the sheet width direction, and a belt member 24 looped around the driving pulley 22 and the driven pulley 23. A tension spring tensions the driven pulley 23 outward, that is, away from the driving pulley 22. A portion of the belt member 24 is fixed to and held by a belt fixing portion at a rear side of the carriage 15 to draw the carriage 15 in the sheet width direction.

To detect a main scanning position of the carriage 15 in the main scanning direction, an encoder sheet is disposed along the sheet width direction in which the carriage 15 moves. An encoder sensor disposed at the carriage 15 reads the encoder sheet to detect the main scanning position of the carriage 15.

In a recording area of a main scanning region of the carriage 15, the rolled sheet 30 is intermittently fed by the sheet feed section 3 in a direction perpendicular to the sheet width direction, that is, the sheet feed direction indicated by an arrow B in FIG. 1.

Outside a range of movement of the carriage 15 in the sheet width direction or at a first end side of the main scanning region of the carriage 15, main cartridges 18 are removably mounted to the apparatus main unit la to store the respective color inks to be supplied to the sub tanks 17 of the recording heads 16. At a second end side of the main scanning region opposite the first end side, a maintenance unit 19 is disposed to maintain and recover desirable conditions of the recording heads 16.

The rolled sheet storage section 4 serves as a sheet feed unit into which the rolled sheet 30 serving as a sheet material for image recording is set. As the rolled sheet 30, rolled sheets of different widths can be set to the rolled sheet storage section 4. The rolled sheet 30 includes a sheet shaft, and flanges 31 are mounted at opposite ends of the sheet shaft. By mounting the flanges 31 to flange bearings 32 of the rolled sheet storage section 4, the rolled sheet 30 is stored in the rolled sheet storage section 4. The flange bearings 32 include support rollers to rotate the flanges 31 while contacting the outer circumference of the flanges 31 to feed the rolled sheet 30 to the sheet feed path.

Figure 2:
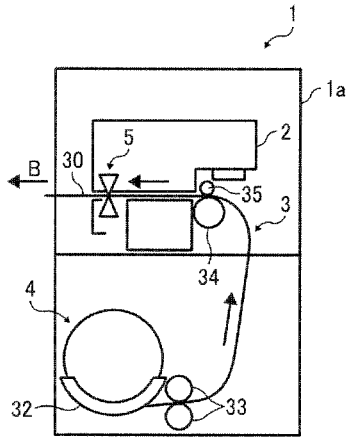
FIG. 2 is a schematic side view of the inkjet recording apparatus illustrated in FIG. 1.

As illustrated in FIG. 2, the sheet feed section 3 includes a pair of sheet feed rollers 33, a registration roller 34, and a registration pressing roller 35. The pair of sheet feed rollers 33 feeds the rolled sheet 30 from the rolled sheet storage section 4 to the sheet feed path. The registration roller 34 and the registration pressing roller 35 are disposed upstream from the image forming section 2 in the sheet feed direction to feed the rolled sheet 30 to the sheet cutting device 5 via the image forming section 2.

After the rolled sheet 30 is fed from the rolled sheet storage section 4, the sheet feed section 3 feeds the rolled sheet 30 forward (toward the left side in FIG. 2) from the rear side (right side in FIG. 2) of the apparatus main unit 1*a* to the predetermined recording area below the image forming section 2. When the rolled sheet 30 is fed to the recording area, the carriage 15 reciprocally moves back and forth in the sheet width direction and the recording heads 16 eject ink droplets in accordance with image information. In addition, while the rolled sheet 30 is intermittently fed forward, the recording heads 16 repeatedly eject ink droplets onto the rolled sheet 30 to record lines of a desired image on the rolled sheet. Thus, the whole image is formed on the rolled sheet 30 in accordance with the image information.

After image formation, the sheet cutting device 5 cuts the rolled sheet 30 to a desired length, and the cut sheet is discharged to a sheet output tray at the front side of the apparatus main unit 1*a*.

Next, the sheet cutting device 5 in this exemplary embodiment is described with reference to FIGS. 3 to 7.

Figure 3:
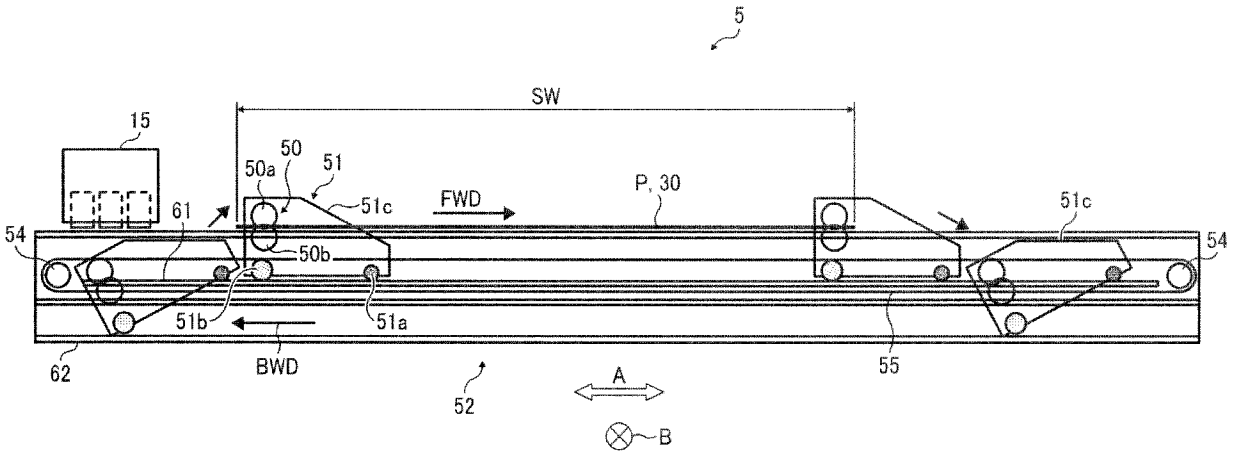
FIG. 3 is a schematic back view of the sheet cutting device according to an exemplary embodiment of this disclosure.

FIG. 3 is a schematic view of the sheet cutting device 5 seen from the back side of the apparatus main unit 1*a*. The sheet cutting device 5 is disposed downstream from the image forming section 2 in the sheet feed direction (see FIG. 2) and has a cutter 50, a cutter holder 51, and a guide member 52 as illustrated in FIG. 3.

The cutter 50 is formed with circular blades 50*a* and 50*b*. The circular blades 50*a* and 50*b* are disposed opposing each other and rotatably held by the cutter holder 51. The circular blades 50*a* and 50*b* rotate with movement of the cutter holder 51 in the sheet width direction indicated by the arrow A in FIG. 2. In other words, the cutter 50 rotates the circular blades 50*a* and 50*b* to cut the rolled sheet 30 and is capable of cutting, e.g., a relatively thick rolled sheet. Additionally, the cutter 50 formed with the circular blades prevents a failure, such as uneven wearing of a particular portion as in a stationary blade. It is to be noted that the number of circular blades is not limited to two and may be three or more. The circular blades 50*a* and 50*b* in this exemplary embodiment serve as cutting portions.

The cutter holder 51 is reciprocally movable back and forth in the sheet width direction. When the cutter holder 51 moves along a forward path (indicated by an arrow FWD in FIG. 3) from the second end side to the first end side of the apparatus main unit 1*a* (see FIG. 1), the cutter 50 cuts the rolled sheet 30. By contrast, when the cutter holder 51 moves along a backward path (indicated by an arrow BWD in FIG. 3) from the first end side to the second end side of the apparatus main unit 1*a* (see FIG. 1), the cutter holder 51 returns to an initial position (hereinafter, home position) with the cutter holder 51 retracted from the sheet feed path downward in a thickness direction (sheet thickness direction) of the sheet, that is, the vertical direction. As a result, on the backward path, the cutter holder 51 is separated from the sheet feed path (indicated by a solid line P in FIG. 3) so as not to block the sheet feed path. The cutter holder 51 is controlled based on positions detected with detectors, e.g., micro switches, disposed at opposite ends in the sheet width direction. In this exemplary embodiment, the above-described forward path serves as a first path of the cutter holder and the above-described backward path serves as a second path of the cutter holder. The configuration of the cutter holder 51 is as follows.

The cutter holder 51 has a driving roller 51*a* and a driven roller 51*b*, and holds the cutter 50 inside. The driving roller 51*a* is connected to a wire 55 extended between a pair of pulleys 54 at opposite ends of the apparatus main unit 1*a* in the sheet width direction. The wire 55 circulates in the sheet width direction via the pair of pulleys 54 rotated by a driving motor. As a result, the driving roller 51*a* is rotationally moved on an upper guide rail 61 in accordance with the circulation of the wire 55. The cutter holder 51 is movable in the sheet width direction in accordance with the movement of the driving roller 51*a*. The driven roller 51*b* is rotatably disposed away from the driving roller 51*a* in the sheet width direction. The driven roller 51*b* moves on the upper guide rail 61 along the forward path of the cutter holder 51 and on a lower guide rail 62 along the backward path. In other words, during the movement of the cutter holder 51, the driven roller 51*b* functions as a positioning member to position the cutter holder 51 with respect to the upper guide rail 61 and the lower guide rail 62. The positioning member of the cutter holder 51 is not limited to the driven roller 51*b* but may be, for example, a circular-arc protrusion. In this exemplary embodiment, the driven roller 51*b* serves as a positioning portion of the cutter holder.

On switching between the forward path and the backward path, the cutter holder 51 pivots in the vertical direction around the driving roller 51*a*. Thus, the cutter holder 51 switches between a first position with which the cutter holder 51 cuts the rolled sheet 30 along the forward path and a second position with which the cutter holder 51 is retracted from the sheet feed path.

Figure 4A:
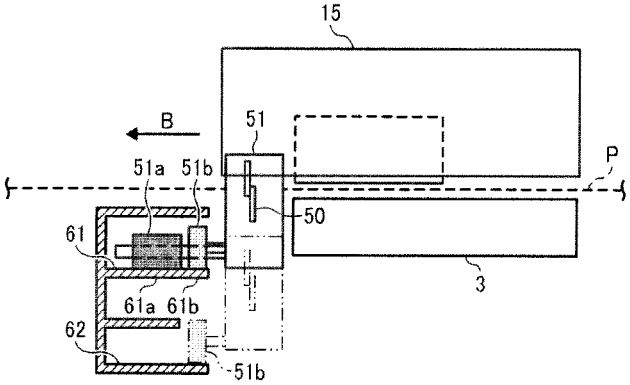
FIG. 4A is a cross-sectional side view of a portion of the sheet cutting device.

As illustrated in FIG. 4A, the driving roller 51*a* and the driven roller 51*b* are offset from each other in the sheet feed direction indicated by the arrow B. Specifically, the driven roller 51*b* is arranged upstream from the driving roller 51*a* in the sheet feed direction. As a result, with the driving roller 51*a* held on the upper guide rail 61, the driven roller 51*b* is movable between the upper guide rail 61 and the lower guide rail 62, thus allowing the cutter holder 51 to pivot around the driving roller 51*a*. In FIG. 4A, a broken line P extending in the direction indicated by the arrow B represents the sheet feed path. In this exemplary embodiment, as illustrated in FIG. 4A, the cutter holder 51 is disposed within the width of the carriage 15 in the sheet feed direction. Alternatively, for example, the cutter holder 51 may be disposed away from the carriage 15 at the upstream or downstream side in the sheet feed direction.

As illustrated in FIG. 3, the cutter holder 51 has a slanted face 51*c* slanted at a predetermined angle from the sheet feed path (indicated by the solid line P) toward the vertical direction. The slant angle of the slanted face 51*c* is set so that the slanted face 51*c* is parallel to the sheet feed path when the cutter holder 51 moves along the backward path.

As illustrated in FIG. 3, the guide member 52 is a guide member to guide the movement of the cutter holder 51 in the sheet width direction, and includes the upper guide rail 61, extending in the sheet width direction for a length that is at least longer than the width (sheet feed width) of the sheet feed path indicated by an arrow SW, and the lower guide rail 62 disposed away from the sheet feed path downward in the vertical direction. The guide member 52 forms the forward path of the cutter holder 51 on the upper guide rail 61 and the backward path of the lower guide rail 62 on the lower guide rail 62. In this exemplary embodiment, the upper guide rail 61 and the lower guide rail 62 are formed as a single member (the guide member 52). Alternatively, the upper guide rail 61 and the lower guide rail 62 may be formed as separate members. In this exemplary embodiment, the lower guide rail 62 serves as a second rail.

Figure 4B:
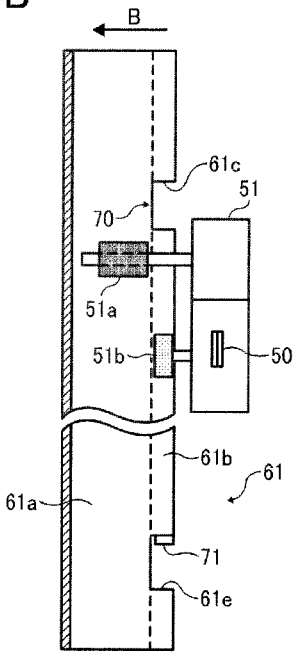
FIG. 4B is a cross-sectional plan view of a portion of the sheet cutting device.

As illustrated in FIGS. 4A and 4B, the upper guide rail 61 has a driving-roller guide area 61*a* to guide the driving roller 51*a* in the sheet width direction and a driven-roller guide area 61*b* to guide the driven roller 51*b* so that the cutter holder 51 moves along the forward path. In this exemplary embodiment, the driving-roller guide area 61*a* and the driven-roller guide area 61*b* are formed as a single rail, that is, the upper guide rail 61. Alternatively, the driving-roller guide area 61*a* and the driven-roller guide area 61*b* may be formed as separate rails. In this exemplary embodiment, the driving-roller guide area 61*a* of the upper guide rail 61 serves as a roller guide rail, and the driven-roller guide area 61*b* serves as a first rail.

Figure 6:
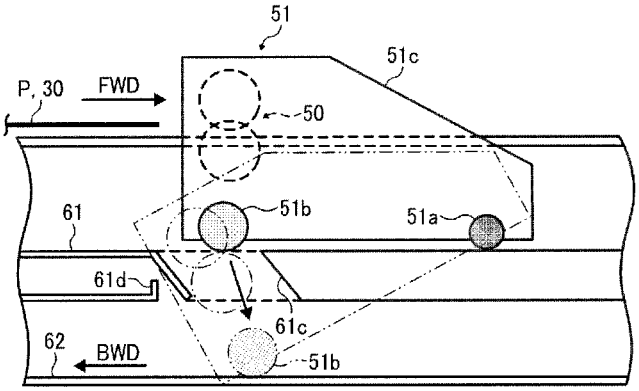
FIG. 6 is a schematic view of the cutter holder shifting to a backward path.

At a first end side of the driven-roller guide area 61*b* in the sheet width direction, a first connection path 61*c* is formed to switch the path of the cutter holder 51 from the forward path to the backward path. As illustrated in FIG. 6, the first connection path 61*c* is formed at the upper guide rail 61 so as to connect the forward path (indicated by an arrow FWD) on the upper guide rail 61 to the backward path (indicated by an arrow BWD) on the lower guide rail 62. Specifically, a predetermined portion of the upper guide rail 61 is cut out at the first end side in the sheet width direction and folded so as to slant downward at a certain angle, thus forming the first connection path 61*c*. Thus, the first connection path 61*c* allows the driven roller 51*b* to move from the upper guide rail 61 to the lower guide rail 62 after the rolled sheet is cut with the cutter 50. A lower end portion 61*d* of the upper guide rail 61 adjacent to the first connection path 61*c* is folded upward so as not to contact the driven roller 51*b* moving along the backward path.

Figure 5:
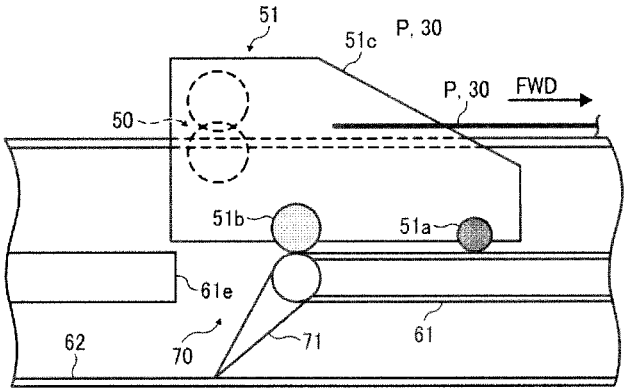
FIG. 5 is a schematic view of a cutter holder of the sheet cutting device having returned to a rolled-sheet cutting area.

As illustrated in FIG. 5, a moving mechanism 70 is disposed at a second end side of the driven-roller guide area 61*b* opposite the first end side in the sheet width direction. When the cutter holder 51 moves from the home position indicated by a solid line in FIG. 10 to the opposite end in the sheet width direction, the moving mechanism 70 moves the driven roller 51*b* from the lower guide rail 62 to the upper guide rail 61, that is, returns the cutter holder 51 to a cutting area (rolled-sheet cutting area) of the rolled sheet.

The moving mechanism 70 includes a second connection path 61*e* to connect the backward path on the lower guide rail 62 to the forward path on the upper guide rail 61, and a switching hook 71 disposed adjacent to the second connection path 61*e* at the upper guide rail 61.

The second connection path 61*e* is formed by cutting out a predetermined portion of the upper guide rail 61 at the second end side in the sheet width direction (see FIG. 4B).

Figure 9:
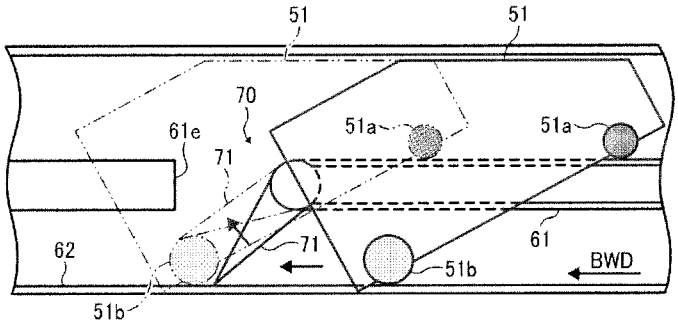
FIG. 9 is a schematic view of the cutter holder returning from the backward path to a home position.
Figure 10:
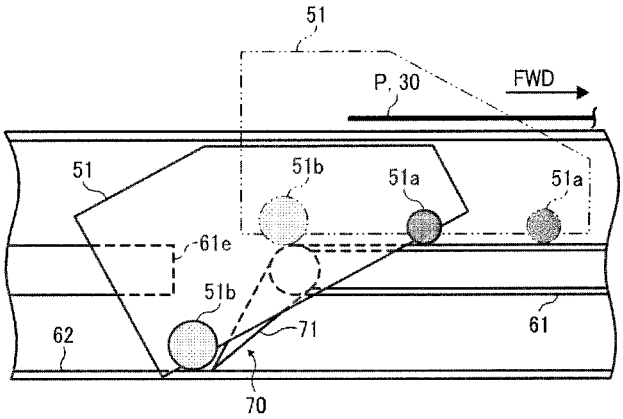
FIG. 10 is a schematic view of the cutter holder returning to the rolled-sheet cutting area.

The switching hook 71 pivots between the backward path and the second connection path 61*e* and is constantly urged downward by an urging member, e.g., a coil spring, so that a tip of the switching hook 71 contacts the lower guide rail 62. As a result, as illustrated in FIG. 9, when the cutter holder 51 moves along the backward path (indicated by an arrow BWD) to the second end side in the sheet width direction, the driven roller 51*b* contacts the switching hook 71 to pivot the switching hook 71 as indicated by a broken line. In this state, when the driven roller 51*b* further moves to the second end side in the sheet width direction, the switching hook 71 is separated from the driven roller 51*b* and returned by the urging member to an initial position, that is, a position indicated by a solid line in FIG. 9. At the initial position indicated by the solid line in FIG. 9, the switching hook 71 is tilted at a predetermined angle. Thus, as illustrated in FIG. 10, when the cutter holder 51 returns from the backward path to the forward path, the driven roller 51*b* can shift from the lower guide rail 62 to the upper guide rail 61 via the switching hook 71. The switching hook 71 may be, for example, a leaf spring. In such a case, the urging member is not necessary. In this exemplary embodiment, the first connection path 61*c* and the moving mechanism 70 serve as a path switching section.

The lower guide rail 62 guides the driven roller 51*b* of the cutter holder 51 moving along the backward path.

Next, operation of the sheet cutting device 5 is described with reference to FIGS. 5 to 10.

As illustrated in FIG. 10, before the rolled sheet 30 is cut, the cutter holder 51 is placed at the home position (indicated by the solid line in FIG. 10) at the second end side in the sheet width direction. When an instruction for sheet cutting is received, by rotating the driving roller 51*a* via the wire 55 (see FIG. 3), the cutter holder 51 is moved from the home position to the rolled-sheet cutting area (a position indicated by a broken line in FIG. 10), and then moved along the forward path (indicated by an arrow FWD in FIG. 10) to the first end side in the sheet width direction. At this time, the cutter 50 cuts the rolled sheet 30 in accordance with movement of the cutter holder 51.

Figure 7:
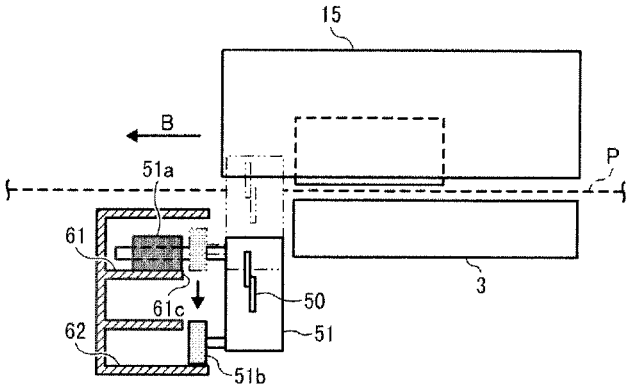
FIG. 7 is a cross-sectional side view of the portion of the sheet cutting device illustrated in FIG. 4A when the cutter holder shifts to the backward path.

Next, as illustrated in FIG. 6, when the cutter holder 51 moves along the forward path (indicated by an arrow FWD) to the first end side in the sheet width direction across the sheet feed path (indicated by a solid line P), the cutting of the rolled sheet 30 is finished. After the cutter holder 51 moves to the first end side in the sheet width direction, the cutter holder 51 pivots downward in the vertical direction around the driving roller 51*a* under its own weight. Specifically, when the driven roller 51*b* moving on the upper guide rail 61 arrives at the first connection path 61*c*, the driven roller 51*b* moves from the upper guide rail 61 to the lower guide rail 62 via the first connection path 61*c*. At this time, as illustrated in FIG. 7, with the driving roller 51*a* retained on the upper guide rail 61, only the driven roller 51*b* moves to the lower guide rail 62 under its own weight. As a result, in FIG. 7, the cutter holder 51 overlapping the sheet feed path indicated by a broken line P pivots to take a position with which the cutter holder 51 is movable along the backward path, that is, the position (indicated by a broken line in FIG. 6) with which the cutter holder 51 is retracted from the sheet feed path.

Figure 8:
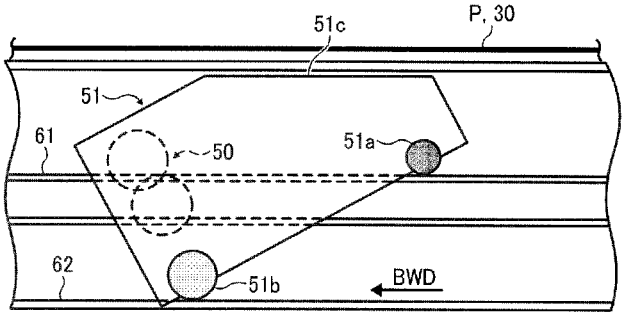
FIG. 8 is a schematic view of the cutter holder moving along the backward path.

Then, based on a position detected by a detector at the first end side in the sheet width direction, the wire 55 (see FIG. 3) is circulated in reverse to rotate the driving roller 51*a* in reverse, that is, in a direction opposite a direction in which the driving roller 51*a* rotates on the forward path. Thus, as illustrated in FIG. 8, with the position retracted from the sheet feed path indicated by the solid line P, the cutter holder 51 moves along the backward path (indicated by an arrow BWD) to the second end side in the sheet width direction. At this time, the slanted face 51*c* is parallel to the sheet feed path and, unlike on the forward path, the cutter holder 51 is retracted downward from the sheet feed path. Thus, when the cutter holder 51 moves along the backward path, the rolled sheet 30 can be fed along the sheet feed path.

Next, as illustrated in FIG. 9, when the cutter holder 51 moves to the second end side in the sheet width direction and arrives at a position adjacent to the moving mechanism 70, the driven roller 51*b* contacts the switching hook 71. With the movement of the cutter holder 51, the driven roller 51*b* pushes up the switching hook 71 as indicated by a broken line in FIG. 9, and moves from the backward path side (the right side of the switching hook 71 in FIG. 9) to the second end side in the sheet width direction, that is, the side of the second connection path 61*e* (the left side of the switching hook 71 in FIG. 9). When the driven roller 51*b* moves to the side of the second connection path 61*e*, the switching hook 71 is separated from the driven roller 51*b* and returned by the urging member to the initial position, that is, the position indicated by the solid line in FIG. 9.

Thus, the reciprocal movement of the cutter holder 51 in the sheet width direction is finished. If the rolled sheet 30 is subsequently fed, the above-described reciprocal movement is repeated.

As described above, in the sheet cutting device according to this exemplary embodiment, when the cutter holder 51 moves along the backward path after the rolled sheet 30 is cut, the cutter holder 51 is retracted downward in the vertical direction from the sheet feed path so as to move away from the sheet feed path. Such a configuration prevents the cutter holder 51 moving along the backward path from getting across the sheet feed path in the sheet width direction, thus preventing the cutter holder 51 moving along the backward path from blocking the sheet feed path. As a result, even when the cutter holder 51 moves along the backward path, a subsequent rolled sheet 30 can be fed, thus enhancing the productivity. Additionally, the cutter holder 51 moving along the backward path is completely retracted from the sheet feed path. Such a configuration prevents the cutter 50 from contacting an already-cut sheet of the rolled sheet 30, thus securely preventing a cut jam or other failure.

In the sheet cutting device according to this exemplary embodiment, the cutter holder 51 is retracted downward in the vertical direction. Such a configuration can reduce, in particular, the width of the apparatus main unit 1*a* in the sheet feed direction as compared to a conventional sheet cutting device that tilts a cutter holder toward a downstream side in a sheet feed direction, thus reducing the size of the apparatus main unit 1*a*.

In the sheet cutting device according to this exemplary embodiment, on switching from the forward path to the backward path, the driven roller 51*b* moves from the upper guide rail 61 to the lower guide rail 62 to pivot in the vertical direction around the driving roller 51*a*. As a result, after the rolled sheet 30 is cut, the cutter holder 51 can be retracted in the vertical direction relative to the sheet feed path. Thus, the cutter holder 51 can move along the backward path in a state in which the cutter holder 51 is retracted relative to the sheet feed path.

In this exemplary embodiment, the sheet cutting device includes the moving mechanism 70 to move the driven roller 51*b* from the lower guide rail 62 to the upper guide rail 61 when the cutter holder 51 moves to the second end in the sheet width direction via the backward path. Thus, the moving path of the cutter holder 51 can be switched from the backward path to the forward path by the moving mechanism 70.

In the sheet cutting device according to this exemplary embodiment, the moving mechanism 70 is simply formed with the second connection path 61*e* and the switching hook 71. Thus, the cutter holder 51 can return from the backward path to the forward path without using a complex mechanism.

In this exemplary embodiment, the sheet cutting device employs the rotationally driven roller 51*b* as a positioning member to position the cutter holder 51, thus allowing smooth movement of the cutter holder 51 in the sheet width direction.

In the sheet cutting device according to this exemplary embodiment, the cutter holder 51 has the slanted face 51*c* slanted at a predetermined angle. Such a configuration can reduce the pivot amount of the cutter holder 51 on switching between the forward path and the backward path, thus reducing the size of the apparatus main unit 1*a*.

In the sheet cutting device according to this exemplary embodiment, the upper guide rail 61 and the lower guide rail 62 are formed as a single member, thus reducing the cost of components.

Figure 11:
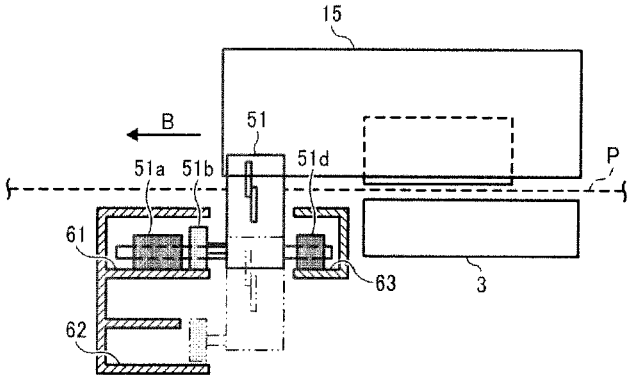
FIG. 11 is a schematic side view of a sheet cutting device according to an exemplary embodiment of this disclosure.

In this exemplary embodiment, as illustrated in FIG. 4A or 4B, the driving roller 51*a* is disposed at only one side of the cutter holder 51, that is, a downstream side of the cutter holder 51 in the sheet feed direction. Alternatively, for example, as illustrated in FIG. 11, another driving roller 51*d* may be disposed at the opposite side of the cutter holder 51. In FIG. 11, the driving roller 51*a* and the driving roller 51*d* oppose each other across the cutter holder 51. In such a case, beside the upper guide rail 61 at the downstream side from the cutter holder 51 in the sheet feed direction, another guide rail 63 corresponding to the driving roller 51*d* is disposed at the upstream side from the cutter holder 51 in the sheet feed direction. In other words, two rails for guiding the driving roller 51*a* and the driving roller 51*d* are arranged in two lines parallel to the direction perpendicular to the sheet feed direction, that is, the sheet width direction. The driving roller 51*a* and the driving roller 51*d* serve as a first driving roller and a second driving roller, respectively, and the guide rail 63 serves as a second roller guide rail.

In this exemplary embodiment, the cutter holder 51 has the driving roller 51*a* at the first end side in the sheet width direction and the driven roller 51*b* at the second end side in the sheet width direction. However, the configuration of the cutter holder 51 is not limited to such a configuration, and for example, the positions of the driving roller 51*a* and the driven roller 51*b* are interchangeable. In such a case, the cutter holder 51 pivots in a direction opposite the pivot direction of the above-described exemplary embodiment. Accordingly, the arrangement of the slanted face 51*c* is modified according to the pivot direction.

Figure 12:
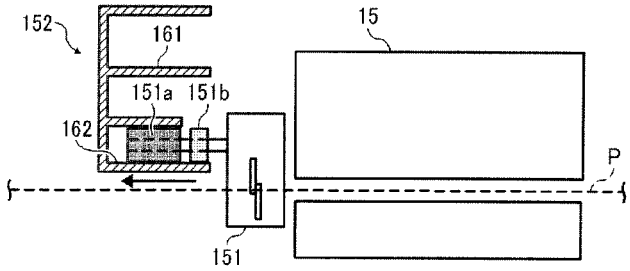
FIG. 12 is a schematic side view of a sheet cutting device according to an exemplary embodiment of this disclosure.

In this exemplary embodiment, the cutter holder 51 is retracted downward in the vertical direction. Alternatively, for example, in a case in which the sheet cutting device 5 is not horizontally disposed relative to the apparatus main unit 1*a*, the cutter holder 51 may be retracted in the thickness direction of the rolled sheet 30 in accordance with the inclination of the sheet cutting device 5. Furthermore, as illustrated in FIG. 12, a cutter holder 151 may be retracted upward in the vertical direction. In such a case, a guide member 152 is disposed above the sheet feed path P. A forward path of the cutter holder 151 is disposed on a lower guide rail 162, and a backward path of the cutter holder 151 is disposed on an upper guide rail 161. As a result, after the cutter holder 151 moves along the forward path to cut the rolled sheet, a driven roller 151*b* moves onto the upper guide rail 161 via a moving mechanism corresponding to the moving mechanism 70 of the above-described exemplary embodiment. Thus, the cutter holder 151 is retracted from the sheet feed path so as to be movable along the backward path. After the cutter holder 151 moves along the backward path, the driven roller 151*b* moves onto the lower guide rail 162 via a communication channel corresponding to the first connection path 61*c* of the above-described exemplary embodiment. Thus, the cutter holder 151 takes a position for cutting the rolled sheet. Such a configuration can obtain effects equivalent to the effects described in the above-described exemplary embodiment.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet cutting device comprising:

a cutter including opposed blades opposing each other with a sheet interposed therebetween to cut the sheet to a desired length, the sheet fed in a sheet feed direction along a sheet feed path to the sheet cutting device;

a cutter holder holding the cutter and reciprocally movable in a width direction that is along a width of the sheet and that is perpendicular to the sheet feed direction in which the sheet is fed along the sheet feed path to the sheet cutting device, and a guide member including a first path to guide the cutter holder to move along the width of the sheet in a forward direction that is perpendicular to the sheet feed direction to cut the sheet with the cutter and a second path to guide the cutter holder to move along the width of the sheet in a reverse direction that is perpendicular to the sheet feed direction after the sheet is cut with the cutter, wherein the second path is disposed away from the first path in a thickness direction that is perpendicular to the sheet feed direction and that is perpendicular to the width direction of the sheet, wherein, when the cutter holder moves along the second path, the cutter holder is retracted away from the sheet feed path in the thickness direction of the sheet.

2. The sheet cutting device according to claim 1, wherein the cutter holder has a first driving roller to move the cutter holder in the width direction of the sheet and a positioning member to position the cutter holder relative to the guide member, the guide member includes a first roller guide rail to guide the first driving roller, a first rail to guide the positioning member to move the cutter holder along the first path, a second rail to guide the positioning member to move the cutter holder along the second path, and a path switching section to shift the positioning member between the first path and the second path, the path switching section includes a first connection path to connect the first path to the second path to shift the positioning member from the first rail onto the second rail, and when the positioning member shifts from the first path to the second path via the path switching section, the positioning member moves from the first rail onto the second rail and the cutter holder pivots around the first driving roller in the thickness direction of the sheet.

3. The sheet cutting device according to claim 2, wherein the path switching section includes a moving mechanism to move the positioning member from the second rail onto the first rail after the cutter holder moves in the width direction of the sheet along the second path.

4. The sheet cutting device according to claim 2, wherein the moving mechanism includes a second connection path to connect the second path to the first path to move the positioning member from the second rail to the first rail and a switching hook disposed at the first rail so as to be pivotable between the second path and the second connection path, when the positioning member contacts and rotates the switching hook with movement of the cutter holder in the width direction of the sheet, the cutter holder shifts from a first side proximal to the second path to a second side proximal to the second connection path, and when the positioning member moves along the switching hook from the second rail onto the first rail, the cutter holder shills from the second path to the first path via the second connection path.

5. The sheet cutting device according to claim 2, wherein the positioning member is a rotatable driven roller.

6. The sheet cutting device according to claim 2, wherein the cutter holder has a slanted face slanted at a predetermined angle in the thickness direction of the sheet relative to the sheet feed path and, when the cutter holder moves along the second path, the slanted face is parallel to the sheet feed path.

7. The sheet cutting device according to claim 2, wherein the first roller guide rail and the first rail are formed as a single rail, and the first driving roller and the position member are offset from each other in the sheet feed direction.

8. The sheet cutting device according to claim 2, wherein the first roller guide rail, the first rail, and the second rail are formed as a single member.

9. The sheet cutting device according to claim 2, wherein the cutter holder has a second driving roller disposed opposing the first driving roller with the cutter interposed between the second driving roller and the first driving roller, and the guide member includes a second roller guide rail to guide the second driving roller in the width direction sheet, the second roller guide rail and the first roller guide rail arranged in two lines parallel to the width direction of the sheet.

10. The sheet cutting device according to claim 2, wherein the first driving roller and the positioning member are offset from each other in the sheet feed direction.

11. The sheet cutting device according to claim 1, wherein the cutter holder has a first driving roller to move the cutter holder in the width direction of the sheet and a positioning member to position the cutter holder relative to the guide member, and wherein the first driving roller and the positioning member are offset from each other in the sheet feed direction.

12. The sheet cutting device according to claim 1, wherein the second path is offset from the first path in the thickness direction.

13. An image forming apparatus comprising:

an image forming device to form an image on a sheet;

a sheet feed device to feed the sheet in a sheet feed direction along a sheet feed path, and a sheet cutting device to cut the sheet fed along the sheet feed path, the sheet cutting device comprising:

a cutter including opposed blades opposing each other with the sheet interposed therebetween to cut the sheet to a desired length;

a cutter holder holding the cutter and reciprocally movable a width direction that is along a width of the sheet and that is perpendicular to the sheet feed direction in which the sheet is fed along the sheet feed path to the sheet cutting device, and a guide member including a first path to guide the cutter holder to move along the width of the sheet in a forward direction that is perpendicular to the sheet feed direction to cut the sheet with the cutter and a second path to guide the cutter holder to move along the width of the sheet in a reverse direction that is perpendicular to the sheet feed direction after the sheet is cut with the cutter, wherein the second path is disposed away from the first path in a thickness direction that is perpendicular to the sheet feed direction and that is perpendicular to the width direction of the sheet, and wherein, when the cutter holder moves along the second path, the cutter holder is retracted away from the sheet feed path in the thickness direction of the sheet.

* * * * *